US010210702B2

(12) United States Patent
Wilder

(10) Patent No.: US 10,210,702 B2
(45) Date of Patent: Feb. 19, 2019

(54) CENTRALIZED MANAGEMENT OF REAL TIME VIRTUAL EXPERIENCES

(71) Applicant: John William Wilder, Helena, AL (US)

(72) Inventor: John William Wilder, Helena, AL (US)

( * ) Notice: Subject to any disclaimer, the term of this patent is extended or adjusted under 35 U.S.C. 154(b) by 239 days.

(21) Appl. No.: 15/003,709

(22) Filed: Jan. 21, 2016

(65) Prior Publication Data

US 2016/0217652 A1 Jul. 28, 2016

Related U.S. Application Data

(60) Provisional application No. 62/108,157, filed on Jan. 27, 2015.

(51) Int. Cl.
*G07F 17/32* (2006.01)

(52) U.S. Cl.
CPC ..... *G07F 17/3225* (2013.01); *G07F 17/3272* (2013.01); *G07F 17/3288* (2013.01)

(58) Field of Classification Search
USPC ..... 463/25
See application file for complete search history.

(56) References Cited

U.S. PATENT DOCUMENTS

| | | | | |
|---|---|---|---|---|
| 8,360,835 | B2 * | 1/2013 | Strause | G06Q 50/34 463/7 |
| 8,708,795 | B2 * | 4/2014 | Napolitano | G07F 17/3244 438/20 |
| 2009/0149233 | A1 * | 6/2009 | Strause | G06Q 50/34 463/7 |
| 2013/0178259 | A1 * | 7/2013 | Strause | G06Q 50/34 463/6 |

* cited by examiner

*Primary Examiner* — Pierre E Elisca
(74) *Attorney, Agent, or Firm* — Carr & Ferrell LLP

(57) ABSTRACT

Centralized management of real time virtual experiences is provided herein. A method includes creating a pool of a plurality players for one or more of a plurality of virtual gaming experiences that are based on real world sporting events, receiving a selection of one of the plurality of virtual gaming experiences from each of the plurality players, monitoring the real world sporting events, determining when one or more of the plurality players wins their respective virtual gaming experience, and awarding one or more of the winning plurality players points.

18 Claims, 9 Drawing Sheets

CENTRALIZED MANAGEMENT OF REAL TIME VIRTUAL EXPERIENCES

CROSS REFERENCE TO RELATED APPLICATIONS

This application claims the benefit of U.S. Provisional Application Ser. No. 62/108,157, filed on Jan. 27, 2015, which is hereby incorporated by reference, including all references and appendices cited therein.

FIELD OF THE INVENTION

The present disclosure pertains to real time virtual experiences, and more specifically, but not by limitation, to systems and methods that allow for real time virtual experiences for a plurality of users managed by a centralized server.

SUMMARY

According to some embodiments, the present disclosure is related to a method of: (a) creating a pool of a plurality players for one or more of a plurality of virtual gaming experiences that are based on real world sporting events; (b) receiving a selection of one of the plurality of virtual gaming experiences from each of the plurality players; (c) monitoring the real world sporting events; (d) determining when one or more of the plurality players win their respective virtual gaming experience; and (e) awarding one or more of the winning plurality players points.

According to some embodiments, the present disclosure is related to a system that comprises (a) a plurality of end user devices that execute a virtual gaming application; and (b) a virtual gaming server that comprises a processor and a memory, the processor executing logic stored in the memory to: (i) create a pool of a plurality players for one or more of a plurality of virtual gaming experiences that are based on real world sporting events; (ii) receive a selection of one of the plurality of virtual gaming experiences from each of the plurality players; (iii) monitor the real world sporting events; (iv) determine when one or more of the plurality players win their respective virtual gaming experience; and (v) award one or more of the winning plurality players points.

Some embodiments include computer readable media that is embedded with logic that can be executed by a computing device. The logic can include any of the methods described herein.

An example embodiment includes (a) means for creating a pool of a plurality players for one or more of a plurality of virtual gaming experiences that are based on real world sporting events; (b) means for receiving a selection of one of the plurality of virtual gaming experiences from each of the plurality players; (c) means for monitoring the real world sporting events; (d) means for determining when one or more of the plurality players win their respective virtual gaming experience; and (e) means for awarding one or more of the winning plurality players points.

It will be understood that a "means for" may be expressed herein in terms of a structure, such as a processor, a memory, an I/O device such as a camera, or combinations thereof. Alternatively, the "means for" may include an algorithm that is descriptive of a function or method step, while in yet other embodiments the "means for" is expressed in terms of a mathematical formula, prose, or as a flow chart or signal diagram.

BRIEF DESCRIPTION OF THE DRAWINGS

The accompanying drawings, where like reference numerals refer to identical or functionally similar elements throughout the separate views, together with the detailed description below, are incorporated in and form part of the specification, and serve to further illustrate embodiments of concepts that include the claimed disclosure, and explain various principles and advantages of those embodiments.

The methods and systems disclosed herein have been represented where appropriate by conventional symbols in the drawings, showing only those specific details that are pertinent to understanding the embodiments of the present disclosure so as not to obscure the disclosure with details that will be readily apparent to those of ordinary skill in the art having the benefit of the description herein.

DETAILED DESCRIPTION

Figure 1:
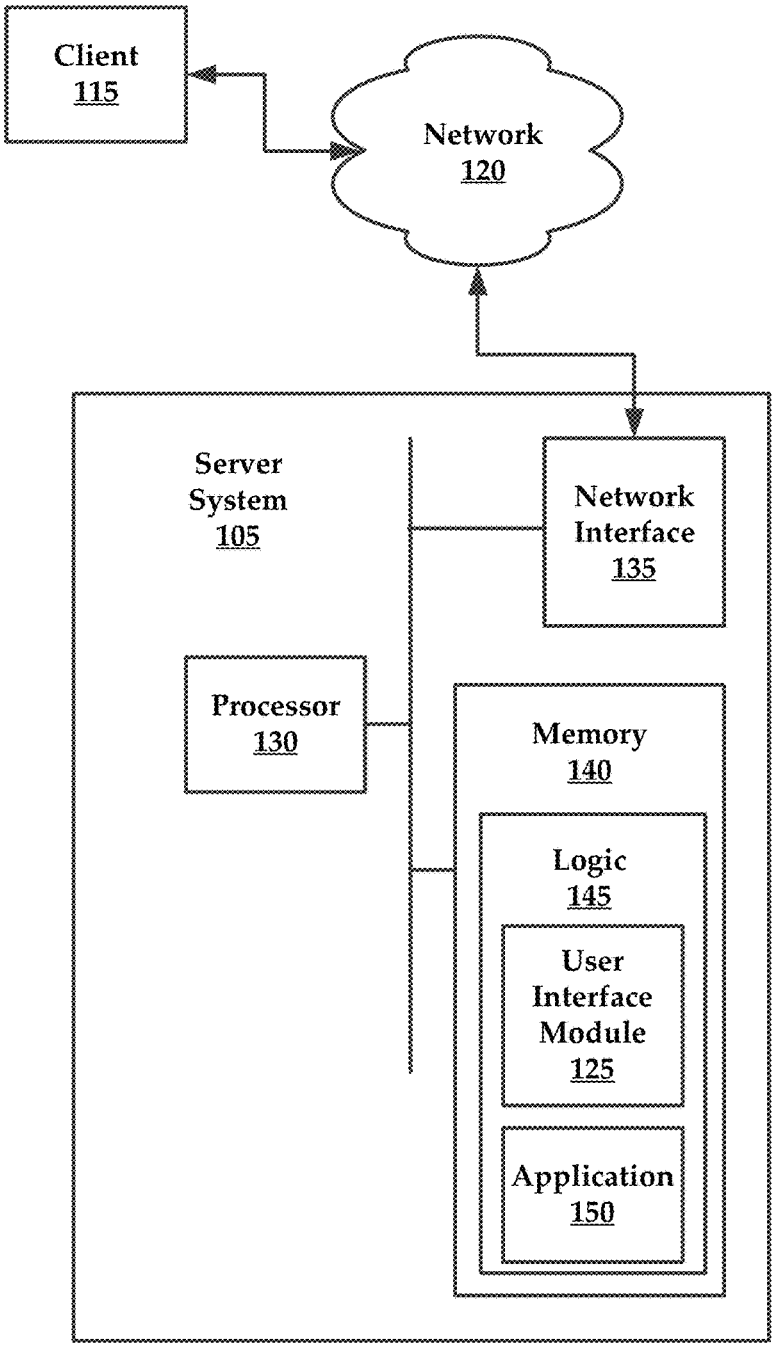
FIG. 1 is a schematic diagram of an exemplary computing system that can be used to practice aspects of the present disclosure.

While this technology is susceptible of embodiment in many different forms, there is shown in the drawings and will herein be described in detail several specific embodiments with the understanding that the present disclosure is to be considered as an exemplification of the principles of the technology and is not intended to limit the technology to the embodiments illustrated.

The terminology used herein is for the purpose of describing particular embodiments only and is not intended to be limiting of the technology. As used herein, the singular forms "a", an and the are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

It will be understood that like or analogous elements and/or components, referred to herein, may be identified throughout the drawings with like reference characters. It will be further understood that several of the figures are merely schematic representations of the present disclosure. As such, some of the components may have been distorted from their actual scale for pictorial clarity.

FIG. 1 illustrates an exemplary architecture for practicing aspects of the present disclosure. The architecture comprises a server system, hereinafter "system 105" that is configured to provide various functionalities, which are described in greater detail throughout this document. Generally the system 105 is configured to communicate with client devices, such as client 115. The client 115 may include, for example, a Smartphone, a laptop, a tablet, a computer, or other similar computing device. An example of a computing device that can be utilized in accordance with the present disclosure is described in greater detail with respect to FIG. 9.

The system 105 may communicatively couple with the client 115 via a public or private network, such as network 120. Suitable networks may include or interface with any one or more of, for instance, a local intranet, a PAN (Personal Area Network), a LAN (Local Area Network), a WAN (Wide Area Network), a MAN (Metropolitan Area Network), a virtual private network (VPN), a storage area network (SAN), a frame relay connection, an Advanced Intelligent Network (AIN) connection, a synchronous optical network (SONET) connection, a digital T1, T3, E1 or E3 line, Digital Data Service (DDS) connection, DSL (Digital Subscriber Line) connection, an Ethernet connection, an ISDN (Integrated Services Digital Network) line, a dial-up port such as a V.90, V.34 or V.34bis analog modem connection, a cable modem, an ATM (Asynchronous Transfer Mode) connection, or an FDDI (Fiber Distributed Data Interface) or CDDI (Copper Distributed Data Interface) connection. Furthermore, communications may also include links to any of a variety of wireless networks, including WAP (Wireless Application Protocol), GPRS (General Packet Radio Service), GSM (Global System for Mobile Communication), CDMA (Code Division Multiple Access) or TDMA (Time Division Multiple Access), cellular phone networks, GPS (Global Positioning System), CDPD (cellular digital packet data), RIM (Research in Motion, Limited) duplex paging network, Bluetooth radio, or an IEEE 802.11-based radio frequency network. The network 120 can further include or interface with any one or more of an RS-232 serial connection, an IEEE-1394 (Firewire) connection, a Fiber Channel connection, an IrDA (infrared) port, a SCSI (Small Computer Systems Interface) connection, a USB (Universal Serial Bus) connection or other wired or wireless, digital or analog interface or connection, mesh or Digi® networking.

The system 105 generally comprises a processor 130, a network interface 135, and a memory 140. According to some embodiments, the memory 140 comprises logic (e.g., instructions) 145 that can be executed by the processor 130 to perform various methods. For example, the logic may include a user interface module 125 as well as a data aggregation and correlation application (hereinafter application 150) that is configured to provide the functionalities described in greater detail herein.

It will be understood that the functionalities described herein, which are attributed to the system 105 and application 150 may also be executed within the client 115. That is, the client 115 may be programmed to execute the functionalities described herein. In other instances, the system 105 and client 115 may cooperate to provide the functionalities described herein, such that the client 115 is provided with a client-side application that interacts with the system 105 such that the server system 105 and client 115 operate in a client/server relationship. Complex computational features may be executed by the server system 105, while simple operations that require fewer computational resources may be executed by the client 115, such as data gathering and data display.

According to some embodiments, the system 105 may include a cloud-based computing environment. In general, a cloud-based computing environment is a resource that typically combines the computational power of a large grouping of processors and/or that combines the storage capacity of a large grouping of computer memories or storage devices. For example, systems that provide a cloud resource may be utilized exclusively by their owners, such as Google™ or Yahoo!™; or such systems may be accessible to outside users who deploy applications within the computing infrastructure to obtain the benefit of large computational or storage resources.

The cloud may be formed, for example, by a network of web servers, with each web server (or at least a plurality thereof) providing processor and/or storage resources. These servers may manage workloads provided by multiple users (e.g., cloud resource consumers or other users). Typically, each user places workload demands upon the cloud that vary in real-time, sometimes dramatically. The nature and extent of these variations typically depend on the type of business associated with the user.

In general, the user interface module 125 may be executed by the system 105 to provide various graphical user interfaces (GUIs) that allow users to interact with the system 105. In some instances, GUIs are generated by execution of the application 150 itself. Users may interact with the system 105 using, for example, a client 115. The system 105 may generate web-based interfaces for the client 115.

Generally, the present disclosure encompasses an application-based sporting game comparison system hereinafter referred to as "application-based game analysis". The application 150 provides a plurality of GUIs that allow an individual/user to interact with, and use features of the application 150.

Broadly speaking, the application 150 provides game analysis. The application 150 can be executed within the context of a computing architecture, such as the architecture of FIG. 1, described in greater detail herein. The application 150 can be executed locally on a user device (e.g., client 115), such as a Smartphone or tablet device. Alternatively, the application 150 can be accessed by a user device over a network. Thus, the application 150 can be executed on a server and accessed by the user device using a browser application. The server will serve GUIs of the application 150 as web pages of a standard or mobile website.

In various embodiments, the server system 105 and client 115 (using the application 150) provide a plurality of virtual gaming experiences for a plurality of players. Each of the players can utilize a client, such as client 115.

The server system 105 can be configured to provide various functionalities, which are described herein in terms of methods. In some embodiments, the server system 105 is configured to allow the plurality of players to register their devices (e.g., clients) and participate in one or more selected virtual gaming experiences. These virtual gaming experiences correspond to real world sporting events such as football games, basketball games, golf, hockey, and other real world sporting events.

Example virtual gaming experiences can comprise a basis or context that includes, but is not limited to wagers regarding conferences or regions to which teams belong, permutations of wagers related to over bets and under bets, multi-team parlay wagers, wagers regarding underdog teams, and wagers regarding favored teams.

Players can choose a time frame for their selected virtual gaming experiences such as one game, one week, season long, month long, and other time frames. Players can play in a single player mode or against other players in a league.

Thus, in some embodiments, the server system 105 can be configured to create a pool of a plurality of players for one or more of a plurality of virtual gaming experiences that are based on real world sporting events. By way of example a plurality of players can create a league and play virtual gaming experiences.

Once the players have selected their desired virtual gaming experiences, the server system 105 will be monitoring the real world sporting events. During monitoring, the server system 105 can push alerts to the players that correspond to scores, updates, and standings of the real world sporting events.

In some embodiments, the server system 105 can push alert notifications to players that correspond to selections of virtual gaming experiences from the plurality of players. For example, a first player selects wagers regarding underdog teams and wagers regarding favored teams. These selections can be pushed as notifications to other players via their client devices.

The server system 105 is configured in some embodiments to determine when one or more of the plurality players win their respective virtual gaming experience. When a player wins one or more virtual gaming experiences, the server system 105 can award points.

The points can be accrued for whatever time frame the player is participating in. For example, points can accrue for a week, a month, or a season.

In some embodiments, the server system 105 can be configured to total points accrued by each of the plurality of players and in some embodiments rank the plurality of players based on total points accrued. Also, the server system 105 can provide alerts in real time to each of the plurality of players that include the rankings of the plurality of players.

According to some embodiments, the server system 105 can facilitate different games between pairs or sub-groups of the plurality of players. For example, the server system 105 can facilitate a head-to-head virtual gaming experience between two or more of the plurality players using any of the virtual gaming experiences described herein.

According to some embodiments, the server system 105 can calculate various outcomes of virtual gaming experiences using indices. Example indices comprise, but are not limited to, an action points index, a point spread index, a money line index, golf odds index and combinations thereof. These can be collectively referred to as a means for determining when one or more of the plurality players win their respective virtual gaming experience.

In some embodiments, points that a player accumulates are based on a value of a selection (wager) in relation to a final outcome of a real world sporting event. The server system 105 picks a point spread, over/under values, money line or other odds. In some embodiments, these selections rely on a Power Index to calculate various results. These power indices can be tailored to various sports. Each real world sporting event is associated with one or more metrics for measuring the team/player value versus an opponent/field of other players.

For example, football and basketball may offer one or more metrics related to action on games compared with a point spread, over/under, or "straight up to win" with a money line index.

Other sports such as MLB and NHL predominantly use a money line index (−140/+125) as a way to measure a team as a favorite or underdog to win straight up.

Golf events can rely on an odds metric (2/1) to measure a probability that a player will win a tournament. Odds can be set per week or in the form of "future odds" that may project the probability weeks or months in advance of a team or player winning the championship. The server system 105 utilizes an "action-specific" index for each sport and each action a player chooses, which allows players to customize wagers and virtual experiences.

In a Point Spread Index, players "Pick the Winners" straight up using a point spread. In an Action Points Index the player picks a cover on the point spread or over/under with additional points for a margin of cover versus a spread or over/under value.

In a Money Line Index, players "Pick the Winners" straight up using a money line.

In a Golf Odds Index, players pick golfers on your team to win or finish in a top 30 of a tournament.

In some embodiments, each index is based on real-time statistical information from a designated sportsbook in Las Vegas. The point spread, over/under values, money line and odds may change in real-time. This adds an additional element of skill to wagers and virtual gaming experiences.

In more detail, in some virtual gaming experiences that include players picking a point spread and over/under, each game can be assigned a value of 300 points, for example. Based on the final score of the game compared with the spread or total, the value will increase or decrease.

A winning outcome earns 300 points while a loss deducts 300 points, by the server system 105 in some embodiments. "Action points" are then added or subtracted by the server system 105 based on the actual score of the game compared with the spread or the total.

The Action Points Index (API) represents a point value of each game based on a final score of a real world sporting event relative to the spread or the over/under values. API is a measure of a team's value based on a game's final outcome.

With respect to point spread based virtual gaming experiences, in an example a first player picks an under score of Alabama −14 vs. Auburn. If Alabama wins the game by a score of 29-13 and covers the spread, the player earns 300 points. According to the API, twenty points (2×10) are added for the "action" vs. the spread. For correctly picking Alabama to cover, the player earns a total of 320 points (300+20). Conversely, if the player picks Auburn +14 in the same game and Auburn does not cover the spread, the player receives a loss of 300 points. According to the API, twenty points (2×10) are deducted for the "action" versus the spread. Incorrectly picking Auburn results in a loss of 320 total points (−300−20).

Any game resulting in a score equal to the spread or the total results in a push (tie) with zero points won or lost by the player.

In some embodiments, the server system 105 can utilize a Point Spread Index (PSI), which represents a relative point value of a team that is picked to win a game. PSI is a measure of a team's value based on a probability of the selected team winning the game. The lower the probability to win, the higher the value of each team. PSI is an algorithm where a point spread is a coefficient that differentiates one team's value from another.

The PSI is a point spread added or subtracted from 30 (for example) and then multiplied by 10 (for example). The equation for PSI is (30+/−spread points×10).

In one example, a player picks Florida −5 to win straight versus Georgia in a football game. The PSI for the Florida as the favorite is 250 (30−5×10). The PSI for Georgia is equal to +5 as an underdog would be 350 (30+5×10). There is greater risk by picking the Georgia as the underdog, but also greater value for a win.

The PSI for a game is equal to 300 in some embodiments. Teams below 300 are favorites while teams above 300 are rated as underdogs by the server system 105. When a player picks on the favorite or the underdog that loses the game, the player is awarded a point value of zero. Real world teams that are favored by −30 or more may not be eligible to be selected in "Pick the Winners" virtual game experience.

With respect to a Pick the Winners" virtual game experience, a player is not simply checking off a box with random winners in the hopes of getting lucky. Skill and strategy are utilized to pick winning teams with the greatest point value according to a Money Line Index.

The server system 105 can utilize the Money Line Index (MLI), which represents a relative point value of a team that is picked to win a real world sporting event. MLI is a measure of a team's value based on a probability of winning the game. The lower the probability to win, the higher the value of each team.

MLI is an algorithm where a money line is the controlling coefficient that differentiates one team's value from another. MLI establishes a "point spread" relative to a money line.

The MLI is used by the server system 105 to create a point spread based on the money line that is added or subtracted from 30 and then multiplied by 10. The equation for MLI is (30+/−point spread×10), in some embodiments. For instance, the money line is set for Red Sox vs. Yankees, with Boston as the favorite at −140. According to the "Money Line Index", −140 is equivalent to a point spread of −2.5. The MLI for the Red Sox would be 275 points (27.5×10). If the Yankees are established as the underdog at +120, the MLI would convert that to a point spread of +1.5. The MLI for the Yankees would be 315 (31.5×10). There is greater risk by picking the Yankees as the underdog, but also greater value for a win.

In an odds based wager, such as on a golf event, the server system 105 can award points to players based on odds. For example, player with a "Top 30 Tournament Finish" earns points in some embodiments. Players finishing 21-30 earn from 100 to 10 points, respectively. Another example wager is a par five, wherein a player can pick five golfers that can add up to a score of 500 points. For example, Jordan Spieth 2/1 (odds)=20 (points); Bubba Watson 5/1 (odds)=50 (points); Phil Mickelson 6/1 (odds)=60 (points); Ricky Fowler 12/1 (odds)=120 (points); and Graeme McDowell 25/1 (odds)=250 (points).

In some embodiments, scoring is based on a finish position of each golfer in a tournament in relation to their assigned point value. For example, if Jordan Spieth is a 2/1 favorite to win a tournament and finishes in third place, the player who picked Spieth would win 300 points (20 player point value+280 tournament finish value).

According to some embodiments, the server system 105 is configured to allow for players or a league of players to appoint a line master or commissioner that can interactively control various aspects of the virtual gaming experiences for the player group.

In one embodiment, the server system 105 can designate one of the plurality players as a line master that is allowed to selectively adjust point spreads for each of the plurality players in the pool. For example, rather than utilizing point spreads provided by professional booking agencies, the line master can establish the point spreads that correspond to real world sporting events. The line master can selectively adjust point spreads to increase or decrease competition within the pool.

Figure 2:
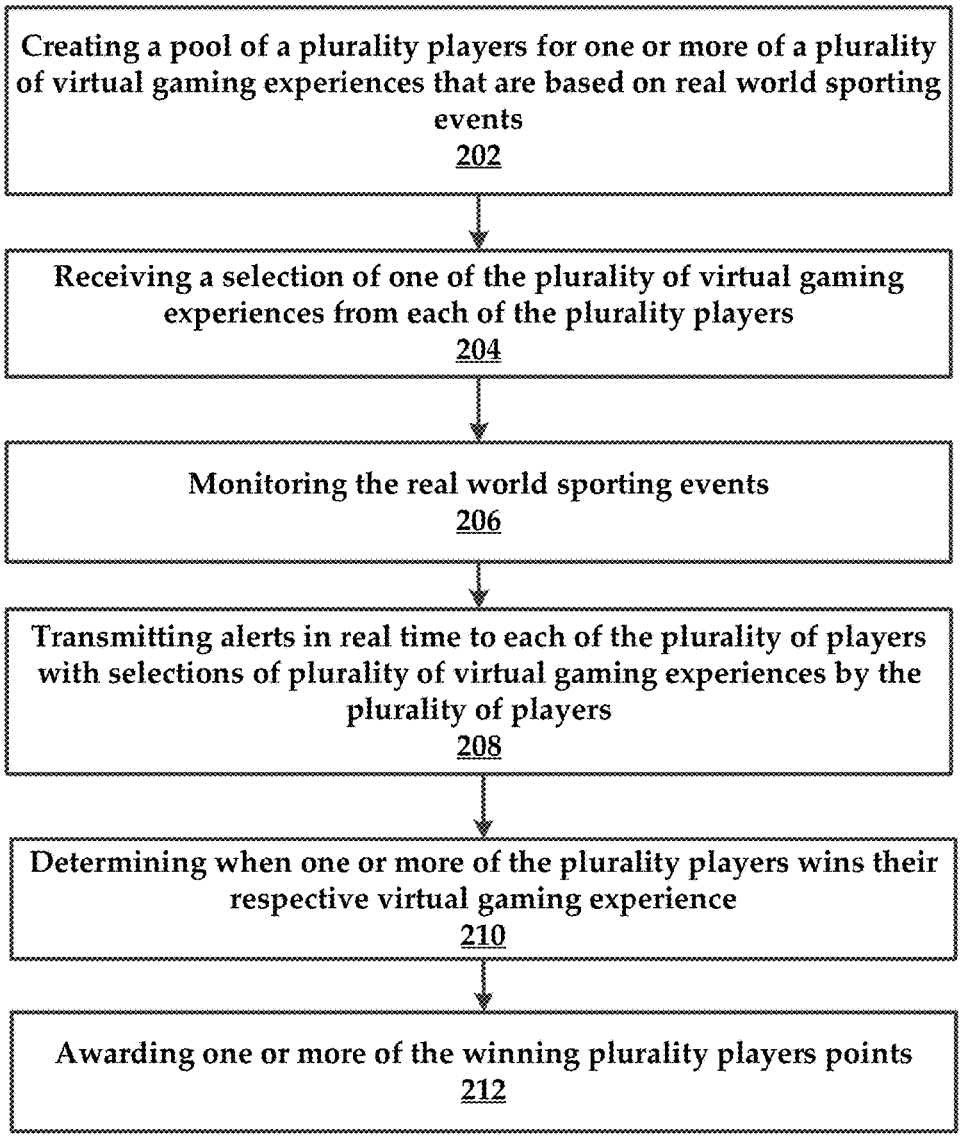
FIG. 2 is a flowchart of an example method of the present disclosure.

In some embodiments, the server system 105 receives the selectively adjusted point spreads from the line master and then applies the selectively adjusted point spreads to the virtual gaming experiences that rely on specific point spreads. FIG. 2 is a flowchart of an example method of the present disclosure.

The method can include a step 202 of creating a pool of a plurality of players for one or more of a plurality of virtual gaming experiences that are based on real world sporting events. For example, the virtual gaming experiences can represent college football games and can also include wagers or a bases for the college football games as described above.

The method can also include a step 204 of receiving a selection of one of the plurality of virtual gaming experiences from each of the plurality players. Thus, each player can choose one or more wagers such as conferences or regions to which teams belong, permutations of wagers related to over bets and under bets, multi-team parlay wagers, wagers regarding underdog teams, and wagers regarding favored teams.

After the players have selected their virtual gaming experiences, the method can include a step 206 of monitoring the real world sporting events. During the real world sporting events, the method can include a step 208 of transmitting alerts in real time to each of the plurality of players with selections of plurality of virtual gaming experiences by the plurality of players. Another example alert includes real time information such as scores, updates, and standings of the real world sporting events.

The method then includes a step of 210 determining when one or more of the plurality players wins their respective virtual gaming experience, and a step of 212 awarding one or more of the winning plurality players points.

Figure 3:
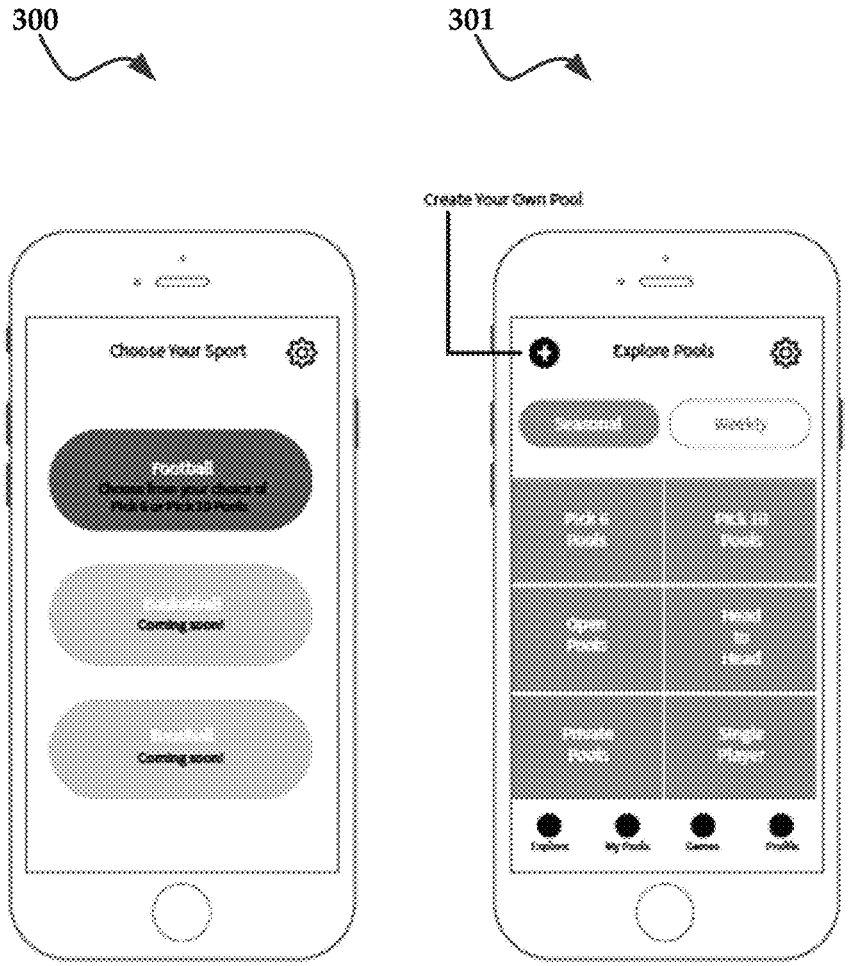
FIGS. 3, 4, 5, 6, 7, and 8 collectively illustrate a plurality of graphical user interfaces (GUIs) that allow users to interact with the system FIG. 1 and allow for the system of FIG. 1 to transmit various alters and feedback to players.

According to some embodiments, the application 150 on the client 115 can be configured to provide various graphical user interfaces (GUIs). FIGS. 3-X include example GUIs that are generated for use in accordance with the present disclosure. FIG. 3 illustrates two GUIs 300 and 301. GUI 301 allows a user to select a sport that corresponds to real world sporting events such as football, basketball, and so forth. GUI 301 allows a user to select a virtual gaming experience and create or join a user pool.

Figure 4:
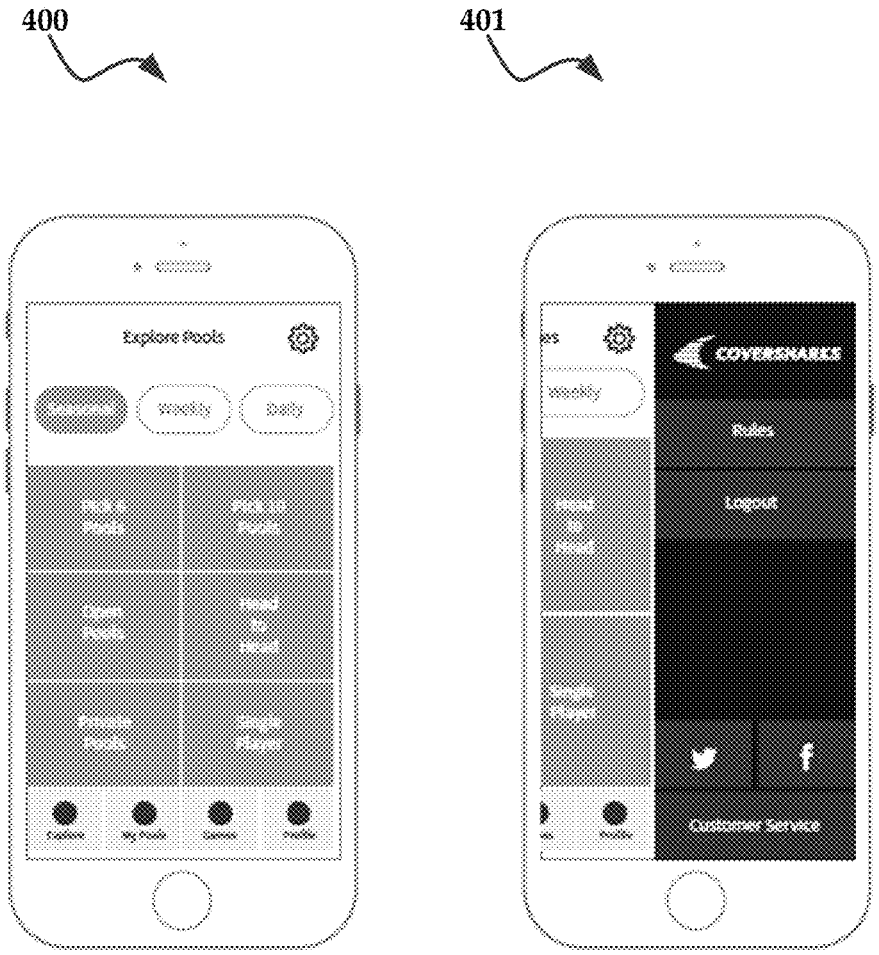

FIG. 4 illustrates two GUIs 400 and 401. GUI 400 includes a pool selection process that allows a user to select a seasonal pool, a weekly pool, or a daily pool. GUI 401 includes a menu that allows a user to read game rules.

Figure 5:
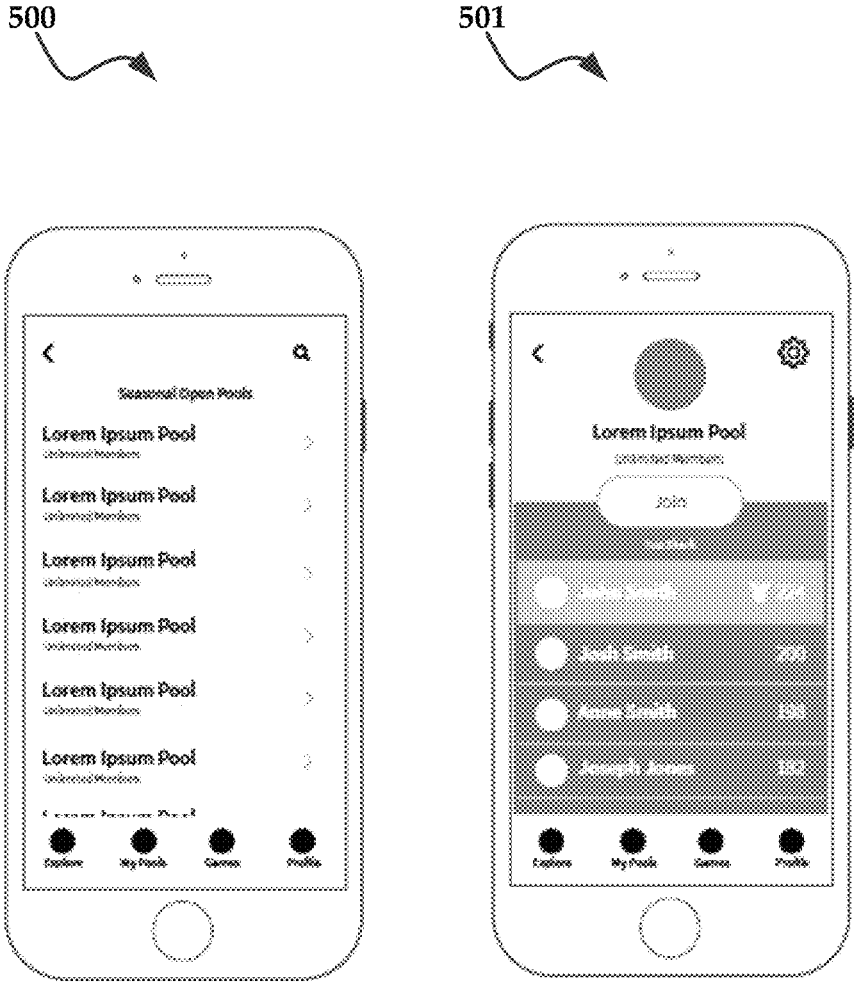

FIG. 5 illustrates two GUIs 500 and 501. GUI 500 allows a user to select a list of pools. GUI 501 illustrates a ranked list of players, which is organized according to player point total.

Figure 6:
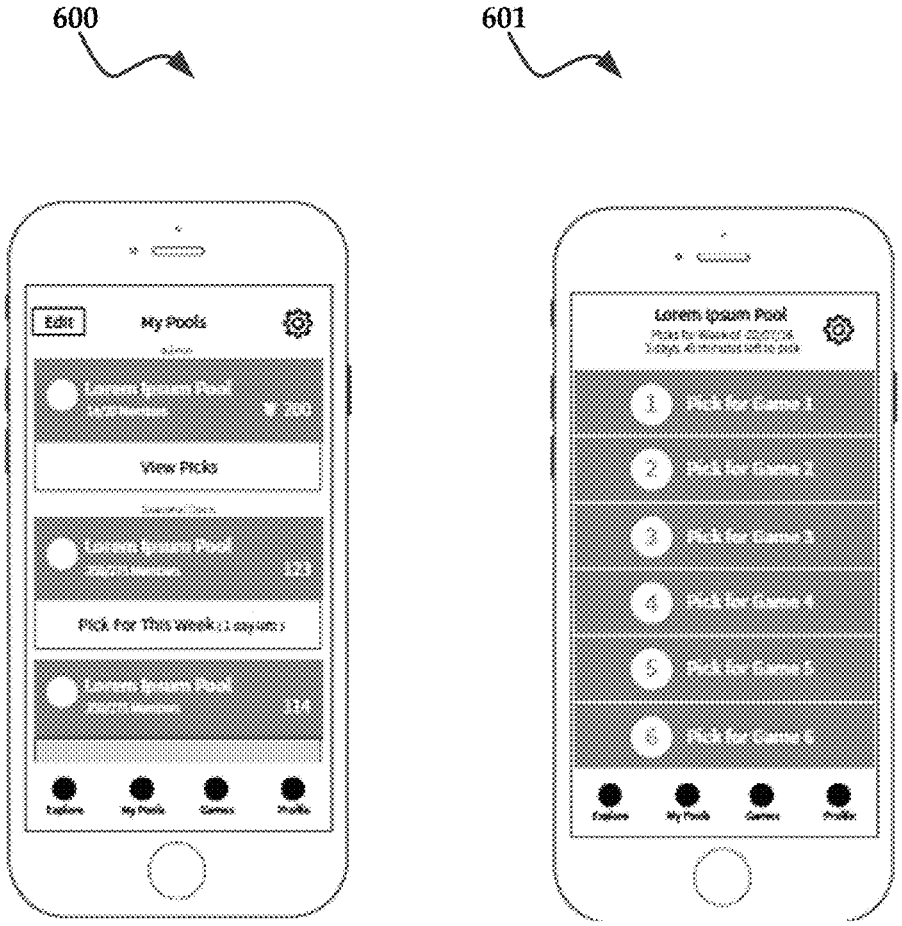

FIG. 6 illustrates two GUIs 600 and 601. GUI 600 illustrates a plurality of virtual game experiences, including pool wagers. GUI 601 illustrates a list of user selections of teams for six virtual game experiences.

Figure 7:
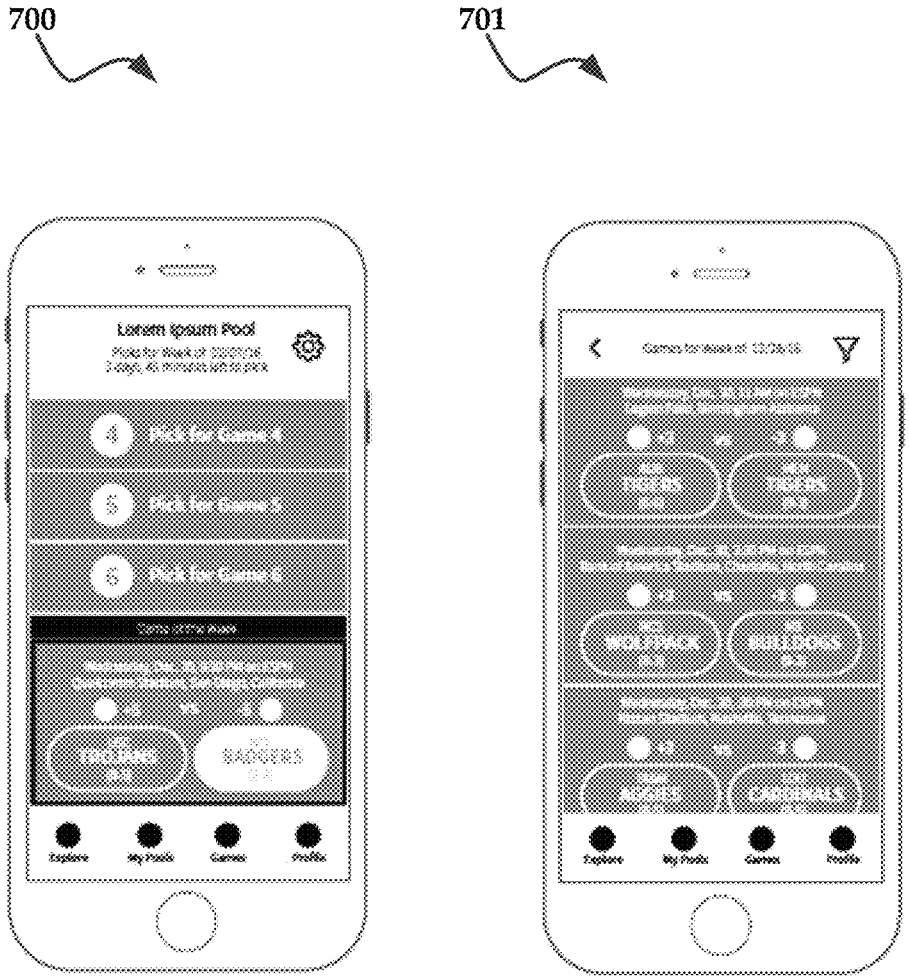

FIG. 7 illustrates two GUIs 700 and 701. GUI 700 illustrates a game of the week virtual game experience and displays selected a real world sporting event in combination with the wager placed by the player. GUI 701 illustrates the details of a plurality of wagers associated with virtual game experiences.

Figure 8:
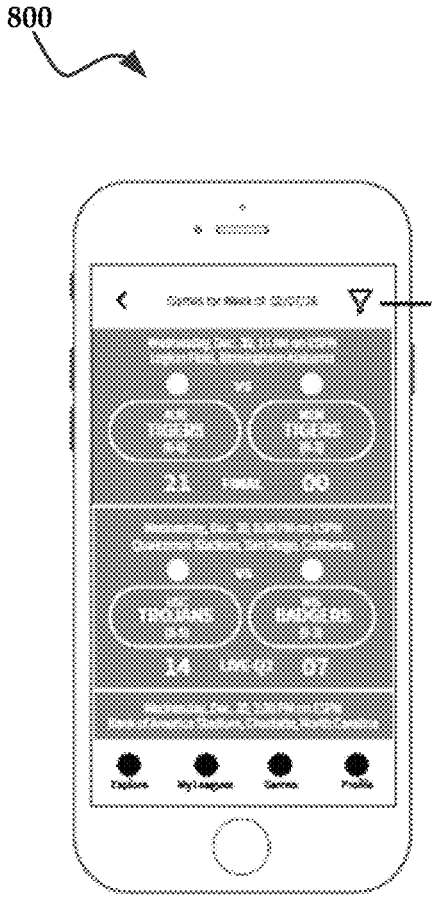

FIG. 8 illustrates a GUI 800 that comprises an alert that includes real time scores for two real world sporting events that are associated with virtual game experiences.

The present disclosure can allow for various modes of play, in some embodiments. In a Single Player Mode, a player can compete as a Single Player to test their skills.

A Division Mode allows players to create divisions or join an existing division of three or more players. The players can customize play with as few or as many players as desired. A division can be ranked by the experience level of players, in some embodiments.

A League Mode provides two options for game play. League Mode allows players to choose from leagues locally or from across the country or world. Other leagues can include professional leagues and/or college leagues that allow players to track real world teams based on whether the teams are college teams or professional teams.

Figure 9:
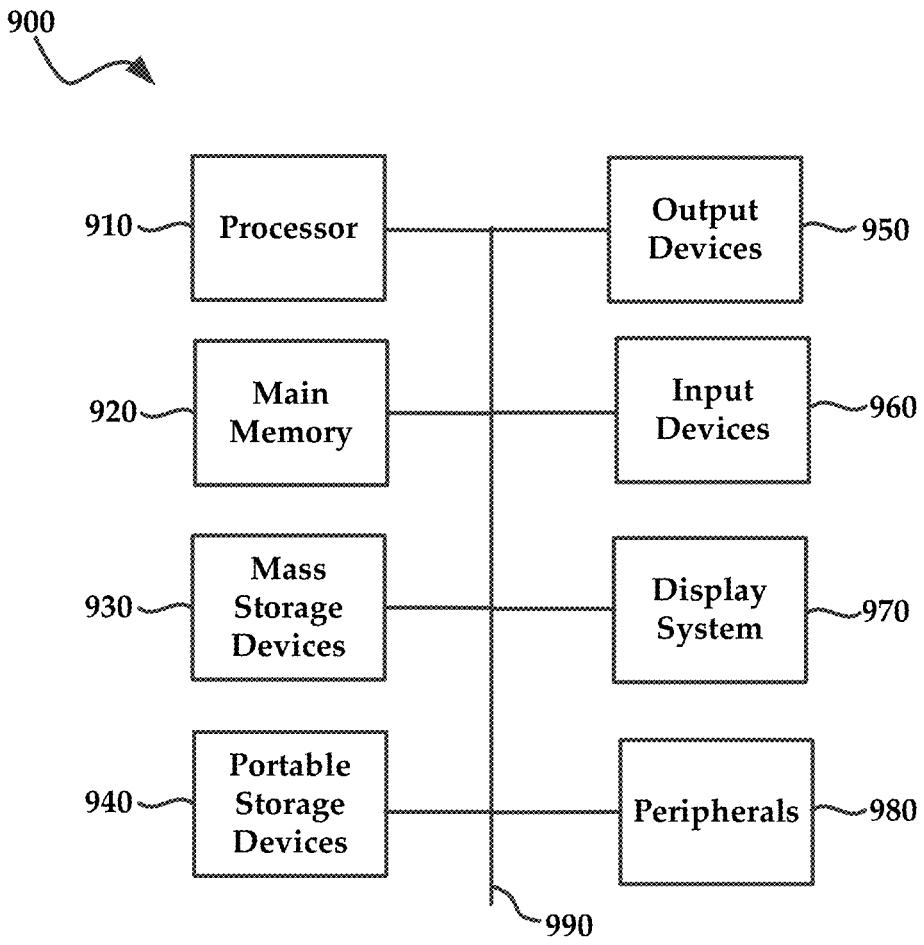
FIG. 9 illustrates an exemplary computing system that may be used to implement embodiments according to the present disclosure.

FIG. 9 illustrates an exemplary computing device 900 (also referenced as computing system 900) that may be used to implement an embodiment of the present systems and methods. The computing system 900 of FIG. 9 may be implemented in the contexts of the likes of a server system 105 that includes processor 130 described herein. The computing system 900 of FIG. 9 includes a processor 910 and main memory 920. Main memory 920 stores, in part, instructions and data for execution by processor 910. Main memory 920 may store the executable code when in operation. The computing system 900 of FIG. 9 further includes mass storage devices 930, portable storage devices 940, output devices 950, user input devices 960, a display system 970, and peripherals 980.

The components shown in FIG. 9 are depicted as being connected via a single bus 990. The components may be connected through one or more data transport means. Processor 910 and main memory 920 may be connected via a local microprocessor bus, and the mass storage devices 930, peripherals 980, portable storage device 940, and display system 970 may be connected via one or more input/output (I/O) buses.

Mass storage devices 930, which may be implemented with a magnetic disk drive or an optical disk drive, is a non-volatile storage device for storing data and instructions for use by processor 910. Mass storage devices 930 can store the system software for implementing embodiments of the present disclosure for purposes of loading that software into main memory 920.

Portable storage devices 940 operates in conjunction with a portable non-volatile storage medium, such as a floppy disk, compact disk or digital video disc, to input and output data and code to and from the computing system 900 of FIG. 9. The system software for implementing embodiments of the present disclosure may be stored on such a portable medium and input to the computing system 900 via the portable storage devices 940.

Input devices 960 provide a portion of a user interface. Input devices 960 may include an alphanumeric keypad, such as a keyboard, for inputting alphanumeric and other information, or a pointing device, such as a mouse, a trackball, stylus, or cursor direction keys. Additionally, the computing system 900 as shown in FIG. 9 includes output devices 950. Suitable output devices include speakers, printers, network interfaces, and monitors.

Display system 970 may include a liquid crystal display (LCD) or other suitable display device. Display system 970 receives textual and graphical information, and processes the information for output to the display device.

Peripherals 980 may include any type of computer support device to add additional functionality to the computing system. Peripherals 980 may include a modem or a router.

The components contained in the computing system 900 of FIG. 9 are those typically found in computing systems that may be suitable for use with embodiments of the present disclosure and are intended to represent a broad category of such computer components that are well known in the art. Thus, the computing system 900 can be a personal computer, hand held computing system, telephone, mobile computing system, workstation, server, minicomputer, mainframe computer, or any other computing system. The computer can also include different bus configurations, networked platforms, multi-processor platforms, etc. Various operating systems can be used including UNIX, Linux, Windows, Macintosh OS, Palm OS, and other suitable operating systems.

Some of the above-described functions may be composed of instructions that are stored on storage media (e.g., computer-readable medium). The instructions may be retrieved and executed by the processor. Some examples of storage media are memory devices, tapes, disks, and the like. The instructions are operational when executed by the processor to direct the processor to operate in accord with the technology. Those skilled in the art are familiar with instructions, processor(s), and storage media.

It is noteworthy that any hardware platform suitable for performing the processing described herein is suitable for use with the technology. The terms "computer-readable storage medium" and "computer-readable storage media" as used herein refer to any medium or media that participate in providing instructions to a CPU for execution. Such media can take many forms, including, but not limited to, non-volatile media, volatile media and transmission media. Non-volatile media include, for example, optical or magnetic disks, such as a fixed disk. Volatile media include dynamic memory, such as system RAM. Transmission media include coaxial cables, copper wire and fiber optics, among others, including the wires that comprise one embodiment of a bus. Transmission media can also take the form of acoustic or light waves, such as those generated during radio frequency (RF) and infrared (IR) data communications. Common forms of computer-readable media include, for example, a floppy disk, a flexible disk, a hard disk, magnetic tape, any other magnetic medium, a CD-ROM disk, digital video disk (DVD), any other optical medium, any other physical medium with patterns of marks or holes, a RAM, a PROM, an EPROM, an EEPROM, a FLASHEPROM, any other memory chip or data exchange adapter, a carrier wave, or any other medium from which a computer can read.

Various forms of computer-readable media may be involved in carrying one or more sequences of one or more instructions to a CPU for execution. A bus carries the data to system RAM, from which a CPU retrieves and executes the instructions. The instructions received by system RAM can optionally be stored on a fixed disk either before or after execution by a CPU.

Computer program code for carrying out operations for aspects of the present disclosure may be written in any combination of one or more programming languages, including an object oriented programming language such as Java, Smalltalk, C++ or the like and conventional procedural programming languages, such as the "C" programming language or similar programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

The corresponding structures, materials, acts, and equivalents of all means or step plus function elements in the claims below are intended to include any structure, material, or act for performing the function in combination with other claimed elements as specifically claimed. The description of the present disclosure has been presented for purposes of illustration and description, but is not intended to be exhaustive or limited to the technology in the form disclosed. Many modifications and variations will be apparent to those of ordinary skill in the art without departing from the scope and spirit of the technology. Exemplary embodiments were chosen and described in order to best explain the principles of the present disclosure and its practical application, and to enable others of ordinary skill in the art to understand the technology for various embodiments with various modifications as are suited to the particular use contemplated.

Aspects of the present disclosure are described above with reference to flowchart illustrations and/or block diagrams of methods, apparatus (systems) and computer program products according to embodiments of the technology. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

These computer program instructions may also be stored in a computer readable medium that can direct a computer, other programmable data processing apparatus, or other devices to function in a particular manner, such that the instructions stored in the computer readable medium produce an article of manufacture including instructions which implement the function/act specified in the flowchart and/or block diagram block or blocks.

The computer program instructions may also be loaded onto a computer, other programmable data processing apparatus, or other devices to cause a series of operational steps to be performed on the computer, other programmable apparatus or other devices to produce a computer implemented process such that the instructions which execute on the computer or other programmable apparatus provide processes for implementing the functions/acts specified in the flowchart and/or block diagram block or blocks.

While the present disclosure has been described in connection with a series of preferred embodiment, these descriptions are not intended to limit the scope of the technology to the particular forms set forth herein. It will be further understood that the methods of the technology are not necessarily limited to the discrete steps or the order of the steps described. To the contrary, the present descriptions are intended to cover such alternatives, modifications, and equivalents as may be included within the spirit and scope of the technology as defined by the appended claims and otherwise appreciated by one of ordinary skill in the art.

What is claimed is:

1. A method using a processor configured to execute steps stored in a memory, the method comprising:

creating a pool of a plurality of players for one or more of a plurality of virtual gaming experiences that are based on real world sporting events;

receiving a selection of one of the plurality of virtual gaming experiences from each of the plurality of players;

monitoring the real world sporting events;

determining when one or more of the plurality of players wins their respective virtual gaming experience;

awarding one or more of the winning plurality of players points; and designating one of the plurality of players as a line master that is allowed to selectively adjust point spreads for each of the plurality of players in the pool.

2. The method according to claim 1, further comprising facilitating a head-to-head virtual gaming experience between two or more of the plurality of players.

3. The method according to claim 1, wherein the virtual gaming experience comprises a basis that comprises any of:

wagers regarding conferences or regions to which teams belong;

permutations of wagers related to over bets and under bets;

multi-team parlay wagers;

wagers regarding underdog teams; and wagers regarding favored teams.

4. The method according to claim 1, further comprising alerting in real time each of the plurality of players with the selections of the plurality of virtual gaming experiences by the plurality of players.

5. The method according to claim 1, further comprising alerting in real time each of the plurality of players with scores, updates, and standings of the real world sporting events.

6. The method according to claim 1, further comprising:

totaling points accrued by each of the plurality of players; and ranking the plurality of players based on the total points accrued.

7. The method according to claim 6, further comprising alerting in real time each of the plurality of players with the rankings of the plurality of players.

8. The method according to claim 1, wherein determining when one or more of the plurality of players wins their respective virtual gaming experience comprises:

calculating an action points index that represents a point value of each of the virtual gaming experiences based on a final score of the real world sporting events, a spread, or an over value or an under value.

9. The method according to claim 8, wherein a real world sporting event resulting in a score equal to spread results of the spread or in a push where zero points are provided to a player.

10. The method according to claim 8, further comprising:

selecting a wager for the selected one of the plurality of virtual gaming experiences; and generating a point spread index that represents a relative point value of a team in one of the real world sporting events that is picked by the player to win a game, wherein the point spread index is a measure of the team's value based on a probability of the team winning the real world sporting event.

11. The method according to claim 1, further comprising:

receiving the selectively adjusted point spreads from the line master; and applying the selectively adjusted point spreads to the virtual gaming experiences.

12. A system, comprising:

a plurality of end user devices that execute a virtual gaming application; and a virtual gaming server that comprises a processor and a memory, the processor executing logic stored in the memory to:

create a pool of a plurality of players for one or more of a plurality of virtual gaming experiences that are based on real world sporting events;

receive a selection of one of the plurality of virtual gaming experiences from each of the plurality of players;

monitor the real world sporting events;

determine when one or more of the plurality of players wins their respective virtual gaming experience; and award one or more of the winning plurality of players points;

wherein the virtual gaming experience comprises a basis that comprises:

wagers regarding conferences or regions to which teams belong;

permutations of wagers related to over bets and under bets;

multi-team parlay wagers;

wagers regarding underdog teams; and wagers regarding favored teams.

13. The system according to claim 12, wherein the virtual gaming server is further configured to facilitate a head-to-head virtual gaming experience between two or more of the plurality of players.

14. The system according to claim 12, wherein the virtual gaming server is further configured to alert in real time each of the plurality of players with the selections of plurality of virtual gaming experiences by the plurality of players.

15. The system according to claim 12, wherein the virtual gaming server is further configured to alert in real time each of the plurality of players with scores, updates, and standings of the real world sporting events.

16. The system according to claim 12, wherein the virtual gaming server is further configured to:

total points accrued by each of the plurality of players;

rank the plurality of players based on the total points accrued; and alert in real time each of the plurality of players with the rankings of the plurality of players.

17. The system according to claim 12, wherein the virtual gaming server is further configured to calculate an action points index that represents a point value of each of the virtual gaming experiences based on a final score of the real world sporting events, a spread, or an over value or an under value.

18. The system according to claim 12, wherein the virtual gaming server is further configured to:

designate one of the plurality of players as a line master that is allowed to selectively adjust point spreads for each of the plurality of players in the pool;

receive the selectively adjusted point spreads from the line master; and apply the selectively adjusted point spreads to the virtual gaming experiences.

* * * * *